US012372246B2

(12) United States Patent
Krausse et al.

(10) Patent No.: US 12,372,246 B2
(45) Date of Patent: Jul. 29, 2025

(54) INPUT AND/OR CONTROL SYSTEM FOR A HOUSEHOLD APPLIANCE, METHOD FOR OPERATING A HOUSEHOLD APPLIANCE AND/OR FOR PROVIDING A HOUSEHOLD APPLIANCE WITH INPUT AND HOUSEHOLD APPLIANCE

(71) Applicant: ELECTROLUX APPLIANCES AKTIEBOLAG, Stockholm (SE)

(72) Inventors: Constantin Krausse, Rothenburg ob der Tauber (DE); Daniel Matulla, Rothenburg ob der Tauber (DE)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 907 days.

(21) Appl. No.: 17/438,963

(22) PCT Filed: Mar. 18, 2020

(86) PCT No.: PCT/EP2020/057428
§ 371 (c)(1),
(2) Date: Sep. 14, 2021

(87) PCT Pub. No.: WO2020/187979
PCT Pub. Date: Sep. 24, 2020

(65) Prior Publication Data

US 2022/0146108 A1 May 12, 2022

(30) Foreign Application Priority Data

Mar. 20, 2019 (EP) ..... 19164064

(51) Int. Cl.
*F24C 7/08* (2006.01)
*F24C 15/20* (2006.01)

(52) U.S. Cl.
CPC ..... *F24C 7/081* (2013.01); *F24C 15/2021* (2013.01)

(58) Field of Classification Search
CPC ..... F24C 15/2021; F24C 7/081; F24C 7/082
See application file for complete search history.

(56) References Cited

U.S. PATENT DOCUMENTS

2015/0044965 A1* 2/2015 Kamon ..... F24C 7/08 455/41.1
2019/0137109 A1* 5/2019 Bruckbauer ..... F24C 7/083

FOREIGN PATENT DOCUMENTS

CN 103000054 3/2013
CN 103417133 12/2013
(Continued)

OTHER PUBLICATIONS

International Search Report and Written Opinion for PCT/EP2020/057428, dated Jun. 9, 2020, 8 pages.
(Continued)

*Primary Examiner* — Thien S Tran
(74) *Attorney, Agent, or Firm* — Chrisman Gallo Tochtrop LLC

(57) ABSTRACT

The present invention relates to an input and/or control system for a household appliance (21). The household appliance comprises first input means (16), operating as command receiving means, for a provision of at least one information input and/or function control input and/or condition control input for the household appliance (21), and second input means (10, 29", 45), operating as confirmation input means, for a provision of a confirmation input in order to cause the input and/or control system or the household appliance (21) to accept and/or to execute the at least one, preferably more than one, information input and/or function control input and/or condition control input. The confirmation input means are particularly designed to accept and/or
(Continued)

execute a confirmation input which is provided prior to the first one of at least one information input and/or function control input and/or condition control input. The present invention also relates to a method for operating a household appliance (21) and/or for providing the household appliance (21) with input. At least one information input and/or function control input and/or condition control input received from a user of the household appliance (21) is processed by the household appliance (21) or by an input and/or control system for the household appliance (21) only after a receipt of a confirmation input, in particular a one-time conformation input, the confirmation input preferably being received prior to the receipt of the at least one information input and/or function control input and/or condition control input.

20 Claims, 3 Drawing Sheets

(56) References Cited

FOREIGN PATENT DOCUMENTS

| | | | | | |
|---|---|---|---|---|---|
| CN | 103856627 | | | 6/2014 | |
| CN | 104136852 | | | 11/2014 | |
| CN | 204044553 | | | 12/2014 | |
| CN | 106358147 | | | 1/2017 | |
| CN | 107783508 | | | 3/2018 | |
| CN | 108488850 | A | * | 9/2018 | ..... F24C 7/082 |
| DE | 102017209885 | | | 12/2018 | |
| DE | 102017209885 | A1 | * | 12/2018 | |
| EP | 2821707 | | | 1/2015 | |
| WO | 2013170520 | | | 11/2013 | |

OTHER PUBLICATIONS

English translation of Chinese Office action in application No. CN 202080019454.7, dated Mar. 28, 2023, 10 pages.

* cited by examiner

INPUT AND/OR CONTROL SYSTEM FOR A HOUSEHOLD APPLIANCE, METHOD FOR OPERATING A HOUSEHOLD APPLIANCE AND/OR FOR PROVIDING A HOUSEHOLD APPLIANCE WITH INPUT AND HOUSEHOLD APPLIANCE

The present invention relates to an input and/or control system for a household appliance, particularly for a kitchen appliance, more particularly for a cooking appliance, preferably for a cooking hob, more preferably for an induction cooking hob. Further, the invention relates to a method for operating a household appliance and/or for providing a household appliance with input. The invention also relates to a household appliance.

Currently, household appliances are operated by the users in an on-site mode, i.e. the users are providing their inputs using user control units and interfaces arranged at control panels of the household appliance. The information or control commands are usually entered manually, however, meanwhile more and more household appliances, which are entering the market, are equipped with hands-free input tools, in particular using voice control, or other types of remote control systems. Different external commands and/or presetting information on an external device with a user interface, for example on a smartphone or a tablet computer, is an attractive possibility to control the functions and operating programs of such appliances, particularly by presetting parameters, like timer values or a clock function, or to control or to set main functions. By way of example, a desired treatment and/or cooking temperature could be set or a specific program, e. g. a complex cooking program, could be selected or programmed.

A remote control of many household appliances, however, is not generally allowed due to legal safety requirements. In particular, the remote control of a cooking hob is not allowed, particularly if it would be activated out of line-of-sight. One reason for such restriction is that currently available hands-free and/or remote control systems are featuring the disadvantage of a potential misinterpretation of a provided voice input. Further, remote settings of parameters, in particular via the internet, wireless local area networks or near field communication systems could be unintended or unwanted, not excluded by misuse. In the case of an activated cooking hob, high damages may occur if it gets out of control and no user can intervene.

The control of the household appliance by the remote device could be allowed, if the distance between the user and the household appliance would be controlled in such way that the user is enabled to intervene or to perform a manual control over the household appliance.

It is an object of the present invention to propose an input and/or control system for a household appliance and/or to propose a method for operating a household appliance and/or for providing a household appliance with input and/or to propose a household appliance, in a way that commands independently from their origin will only be processed or executed when a reliable control of the household appliance is secured.

According to the present invention, an input and/or control system for a household appliance is provided which comprises first and second input means. The household appliance may be a kitchen appliance, particularly a cooking appliance, preferably a cooking hob and more preferably an induction cooking hob. The first input means are operating as command receiving means for the household appliance and are adapted for a provision of at least one information input and/or function control input and/or condition control input, particularly operation condition control input. The second input means are operating as confirmation input means and are adapted for a provision of a confirmation input in order to cause the input and/or control system or the household appliance to accept and/or to execute the at least one information input and/or function control input and/or condition control input. Preferably, the input and/or control system shall be caused to accept and/or to execute more than one information input and/or function control input and/or condition control input. The input and/or control system may be designed to accept and/or to process and/or to execute an information input and/or function control input and/or condition control input which is provided after or at least concurrently with the confirmation input.

The term "provision" in that sense may be interpreted as a user's action and a provision of an input may be a user's performance of entering any kind of information into the input and/or control system or into a control unit of the household appliance. Another interpretation of "provision", in particular in connection with confirmation input, may be an automatic performance by the system, particularly triggered by any predefined condition.

The main idea of the present invention is that the input and/or control system of the household appliance is designed in that way that a user's data and/or information input and command is processed only, if not only the at least one information input and/or function control input and/or condition control input is provided, but also the confirmation signal for confirming the user's attendance and/or the user's ability to intervene is received by the household appliance and/or the input and/or control system.

The confirmation input may be a local input, i. e. a user providing the confirmation input is standing or is located near by the household appliance while providing the confirmation input. In that case, and preferably in case of providing means for identifying the user's close-by location, a short reaction time, when necessary, can be assumed.

In an embodiment, the second input means is a button, which may be a switch-on and/or switch-off button, or it is a touch element, particularly a touch key or a touch-sensitive element or touch-sensitive area. The touch element may be located on or may be part of a TFT-display. Preferably, the button or touch element is located on a user interface of the household appliance.

Optionally, the second input means may be a near field communication means, e.g. an infrared, an ultrasonic sound or a Bluetooth remote control device which may trigger the confirmation input when respectively operated by the user.

A further embodiment provides for the confirmation input or confirmation trigger arrangement being arranged in and/or monitoring the installation location, in particular the installation room, of the household appliance and the confirmation input may be performed or triggered by the user's action of switch-on of the household appliance.

The confirmation input means or confirmation trigger arrangement may be a camera and/or a microphone, a vibration sensor, an infrared sensor and/or a light beam located in or on or close by the household appliance and monitoring the environment or surroundings of the household appliance, and, again, the confirmation input may be performed or triggered by the user's action of switch-on of the household appliance.

The invention may be specifically designed for a household appliance which is a cooking hob, wherein the confirmation input means or the confirmation trigger arrangement is arranged at an appliance, in particular another household appliance, which may be an oven or an exhaust hood.

Another option for the second input means could be a voice control arrangement, in particular a digital or virtual assistant, which is positioned in close proximity to the household appliance. In such arrangement, it may send a position identification signal to the household appliance, particularly if respectively activated by the user.

A specific embodiment of the invention provides for a household appliance and/or input and/or control system which comprises a physical key, in particular a button or a touch element, and/or a signal provider. A current flow to and/or voltage application at an electrical load or device, which may be a heating element or a control unit, is enabled only when the physical key is pressed and/or activated and/or when the signal provider is providing an enabling signal.

The confirmation input or signal provision may be a one-time input. In that case, the user is providing the confirmation input or signal only once and all simultaneous or successive information and/or function control and/or condition control inputs are or will be processed.

In a preferred embodiment, the first input means and the second input means are connected to or acting on a relay and/or to a comparator and/or a logic element, in particular an AND element, which is a physical implementation in the input and/or control system or in a control unit and/or a control circuitry of the household appliance.

The first input means may be a parameter input means and/or a control command means and it may be a remote control means. Notably, the system may be or comprise a voice-operated and/or gesture-operated input or control means.

In a specifically preferred embodiment, the first input means is an apparatus or an uncoupled or stand-alone device connected to the household appliance. In particular, it is connected to a control unit of the household appliance, via local area network connection means or via WIFI connection means. The first input means may be or may be connected to a digital or virtual assistant device, for example "Google Home" (trademark, registered by Google LLC with effect for many countries), "ALEXA" (trademark, registered by Amazon Technologies, Inc. with effect for many countries) or "SIRI" (trademark, registered by Apple Inc. with effect for many countries), or the like.

Additionally or alternatively, the first input means may be or may comprise a component or a device or an electric circuit integrated in the household appliance.

The input and/or control system specifically comprises a first first input means and a second first input means, as well as a first second input means and a second second input means. In that specific embodiment, the first first input means operates as a local command receiving means and is adapted for a provision of at least one locally provided information input and/or function control input and/or condition control input, which may be an operation condition control input, for the household appliance and the second first input means is a button or key for a switch-on of the household appliance or a button or key which may be activated directly after the switch-on of the household appliance. Further, that specific embodiment is also designed in that the first second input means operates as remote command receiving means, i.e. it is adapted for a provision of at least one remotely provided information input and/or function control input and/or condition control input, which may be an operation condition control input, for the household appliance. Consequently and in addition, the second second input means operates as confirmation input means and is adapted for a provision of a confirmation input in order to cause the input and/or control system or the household appliance to accept and/or to execute the at least one remotely provided information input and/or function control input and/or condition control input.

According to another aspect of the invention, a method for operating a household appliance and/or for providing a household appliance with input is provided, wherein at least one information input and/or function control input and/or condition control input received from a user of the household appliance is processed, in particular accepted and/or executed, by the household appliance or by an input and/or control system for the household appliance only after and/or under the precondition of a receipt of a confirmation signal or input. The confirmation signal or input may be a one-time input, i.e. the user is providing the confirmation signal only once and all simultaneous or successive information and/or function control and/or condition control inputs are or will be processed. In particular, the confirmation input is received prior to or at the latest simultaneously with a first one of the at least one information input and/or function control input and/or condition control input.

The method may be designed in that the confirmation input is received from a user of the household appliance who is located near by the household appliance while providing the confirmation input. Respective identification means or methods, as described above, may be provided for identification or recognition of the user's location or position.

In a specific input and/or control system or in a specific method, the confirmation input is operating for and/or controlling at least one, preferably more than one, information input and/or function control input and/or condition control input.

The confirmation input is particularly operating and/or controlling for a predefined or predefinable period of time. As soon as this time period expires, the user will need to provide a confirmation signal or input again, otherwise the input and/or control system and/or the household appliance will no longer process successive information and/or function control and/or condition control inputs. Additionally or alternatively, the confirmation input may operate and/or control until a further user action is provided. This may be a switch-off of the household appliance.

In order to increase the safety of the controlling of the household appliance and in order to provide feedback to the user, the method may comprise an informational step which provides a communication of the received confirmation input or signal by the input and/or control system and/or by a user interface of the household appliance after the receipt thereof. The communication may be performed by displaying the receipt of the confirmation signal or input on a display of the user interface or a voice output of the received confirmation signal or input by means of a loudspeaker. This may be just a beep or similar acoustic signal.

The confirmation signal or input may be activated, in particular actively activated, by the user, or alternatively, the confirmation signal or input may be directly triggered merely by his physical presence close by the household appliance, e.g. immediately after a user's switch-on of the household appliance.

The confirmation input means may be arranged or designed in a way that only an authorized user is able to press or activate it. Additionally or alternatively, the confirmation signal or input may be a direct, in particular physical, operation of a device or appliance by the user, which device or appliance is arranged near by the household appliance.

Another option for a confirmation input or signal may be a presence detection signal which identifies a user's, particularly an authorized user's, presence close by the household appliance. Such a presence detection and indication may be realized by an infrared signal, a camera signal, a photo sensor signal, a light beam signal and/or an acoustic signal, and the presence detection method step may be executed directly after the user's action of switch-on of the household appliance.

Novel and inventive features of the present invention are set forth in the appended claims.

The present invention will be described in further detail with reference to the drawings, in which FIG. 1 illustrates a schematic view of an input and/or control system for a household appliance according to a preferred embodiment of the present invention;

The input and/or control system comprises an acoustic sensor device 10, a voice recognition device 12 and a user recognition device 14 comprising the acoustic sensor device 10 and the voice recognition device 12. For example, the acoustic sensor device 10 is a microphone. Instead of the acoustic sensor 10 another sensor type may be used for detection of a presence of a user, e. g. an infrared sensor or a camera.

Figure 1:
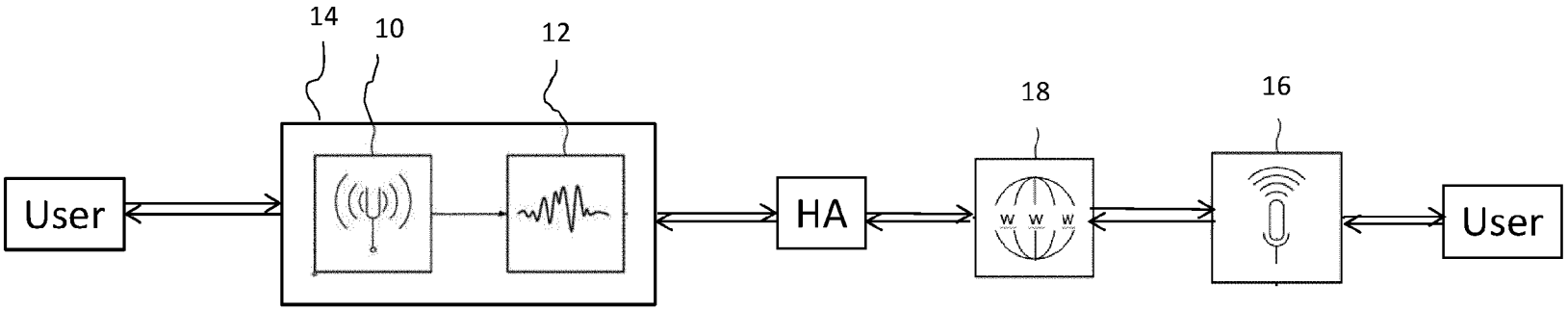
FIG. 1 illustrates a schematic view of an input/and/or control system for a household appliance HA according to a first preferred embodiment of the present invention.

Further, the input and/or control system may comprise an audio output device, e.g. a loudspeaker, for communicating with the user. The input and/or control system further comprises a control unit of the household appliance HA (indicated by a double arrow in FIG. 1).

A voice control communication device 16 is provided and adapted to receive vocal input from the user and to perform acoustic output to the user. Both the voice control communication device 16 and the household appliance HA are able to communicate with the internet 18, in particular they are able to communicate with each other via the internet 18. Preferably, the input and/or control system, or any part thereof, is a part, e.g. an integrated part, of a control unit of the household appliance HA.

The input and/or control system is provided for activating the connection of the household appliance HA to the voice control communication device 16 and/or to the internet 18. "Activating" in that sense means that particularly inputs, i. e. control commands or other types of information or data provisions, are only received or processed by the household appliance HA when granted by the input and/or control system.

The voice recognition device 12 and/or the user recognition device 14 is or are configured to sense the presence of a user, in particular of an authorised user. In particular, the voice recognition device 12 and/or the user recognition device 14 is or are configured such that the presence of the person adjacent to the domestic appliance DA is detected (i. e. whatever user or person) and/or specified (i. e. only authorized user).

Further, the acoustic sensor device 10 is capable of detecting and/or receiving a user generated input signal, for example the voice of the user, another audio signal from the user or noise generated by the user. For example, the acoustic sensor device 10, the voice recognition device 12 and/or the user recognition device 14 may be or comprise a decibel sensor.

The user recognition device 14 is configured to compare a parameter of the user generated input signal, e.g. the frequency, amplitude, frequency pattern and/or amplitude pattern, with a predetermined threshold value. Said predetermined threshold value is chosen in such a way that it is assigned to a certain amplitude of the user specific noise or reflects said certain amplitude, e.g. the loudness of the voice. For a proper operation, this assignment will have to be a matter of training or calibration at the moment of implementation of the household appliance HA. Alternatively, the producer of the household appliance HA may set it before the delivery to the user.

For example, the input and/or control system is capable of recognising, if the person adjacent to the sensor is speaking loudly. The acoustic sensor device 10 may be also replaced by another type of presence detection sensor, in particular a near field sensor, a touch sensitive sensor, an optical sensor, a camera and/or a vibration sensor.

The input and/or control system is configured in such a way that a communication of the voice control communication device 16 with the household appliance HA is possible only, if the user inputs a certain input signal recognised by the user recognition device 14. For example, the user recognition device 14 detects, if the user is speaking with certain loudness, or if the user outputs certain sequence of words, signals, tapping, knocking or the like.

The user detection or recognition may be activated permanently. However, the present embodiment is designed in that way that a one-time confirmation input or signal is provided to the input and/or control system directly after the user's switch-on of the household appliance HA. In this situation, the user is located next to the household appliance HA because of an ON/OFF switch is positioned on a user interface of the household appliance HA. After receipt of this confirmation input, the user's attendance and potential intervention in case of uncontrolled operation of the household appliance HA is assumed and the user is enabled to provide the household appliance HA with commands and/or inputs via the voice control communication device 16 and the internet 18.

Figure 2:
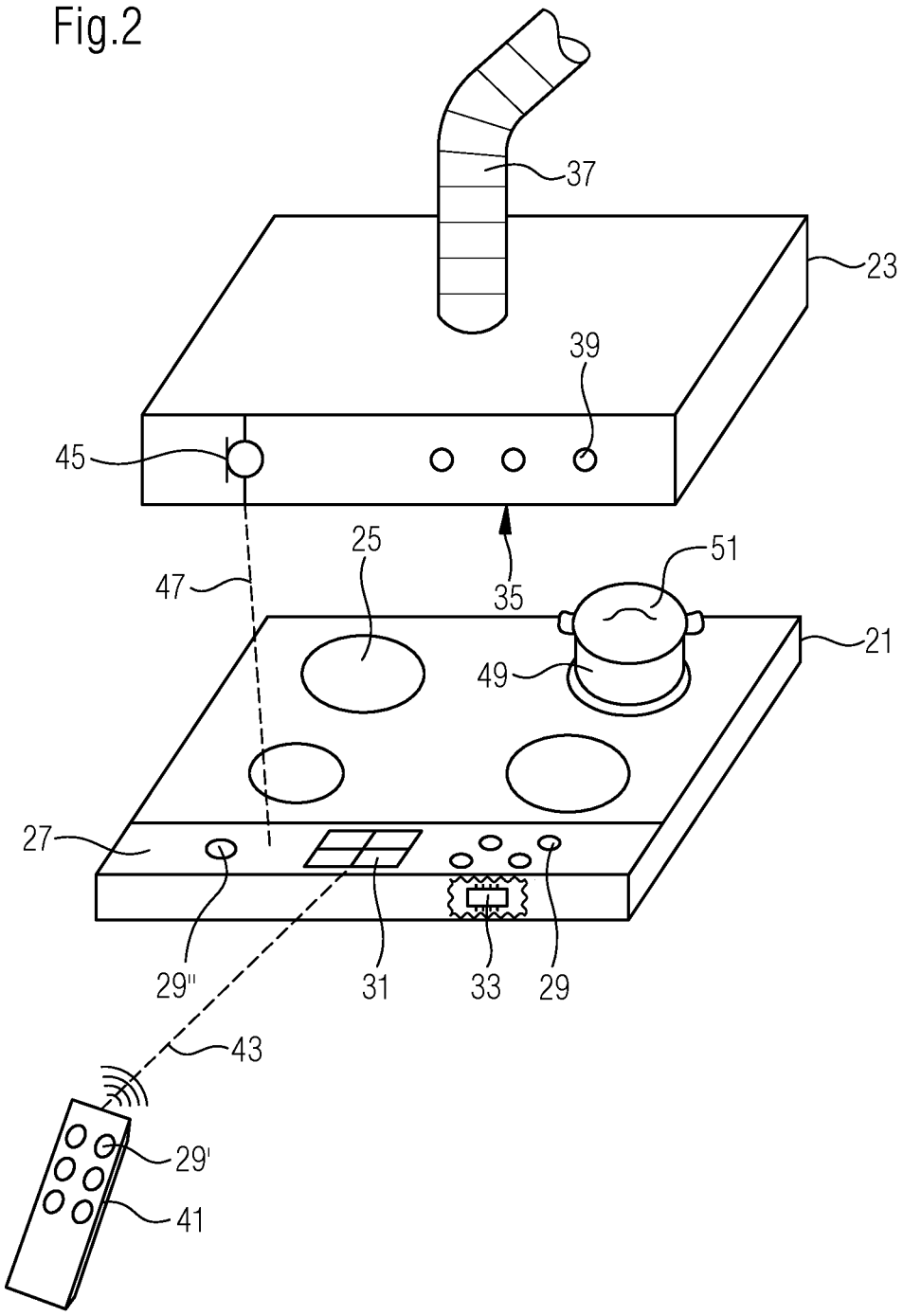
FIG. 2 illustrates a schematic perspective view of a cooking arrangement comprising a cooking hob and an exhaust hood and a remote control device according to another preferred embodiment of the invention.

FIG. 2 illustrates an input/and/or control system for a household appliance HA according to a second preferred embodiment of the present invention. The figure shows a schematic perspective view of a cooking arrangement comprising a cooking hob 21 and an exhaust hood 23. The cooking hob 21 comprises a cooking area with four cooking zones 25 and an operator control panel comprising a user interface 27. The user interface 27 is equipped with operating buttons 29 and a display unit 31. In the interior of the operator control panel, a microcontroller 33 is arranged for controlling the operation of the cooking hob 21. The user interface 27 is internally connected with the microcontroller 33 for data exchange between these two components.

The exhaust hood 23 is arranged above the cooking hob 21 by fully covering the cooking area of the cooking hob 21 with its suction area 35. The vapour and/or fume which is/are resulting from the cooking processes are sucked by an exhaust fan (not shown) arranged inside the exhaust hood 23 and removed from the kitchen, in which the cooking arrangement is installed, to the environment by means of an exhaust tube 37. Hood operating buttons 39 are positioned on a front face of the exhaust hood 23 for the operation thereof by the user.

The operation of the cooking hob 21 can be performed manifold. According to a first way of operation, a conventional, direct operation may be realized by the user manipulating the hob operating buttons 29 arranged on the user interface 27 in order to set or modify the power level of the respective cooking zone 25. In a similar way, the exhaust hood 23 may be operated also directly in a conventional way by the user manipulating the hood operating buttons 39, thereby controlling the speed of the exhaust fan.

In another way of operation, both the cooking hob 21 and the exhaust hood 23 may be operated by the user using a remote control device 41. Via a first transmission path 43 (in FIG. 2 only illustrated for the connection to the cooking hob 21), the remote control device 41 transmits the information signals to either the cooking hob 21 or to the exhaust hood 23. The first transmission path 43 may be a Wi-Fi or a near field connection. A switch button (not explicitly shown) is comprised by the remote control device 41 for selecting either control of the cooking hob 21 or control of the exhaust hood 23 by the remote control device 41. The user inputs the commands for the control of either the cooking hob 21 or the exhaust hood 23 by means of universal operating buttons 29' arranged on the remote control device 41.

While the exhaust hood 23 may be controlled via the remote control device 41 without any limitation, the operation of the cooking hob 21 is only allowed, following safety standards, in case of the user of the cooking hob 21 being in close distance to the cooking hob 21 in order to be in a position to intervene in case of any unexpected or dangerous situation resulting from the cooking hob operation.

Therefore, even though the microcontroller 33 will receive a control command transmitted via the first transmission path 43 and forwarded by the user interface 27, the microcontroller 33 will not readily process the received control command. Rather, the microcontroller 33 only processes the command in case of having received a confirmation input or signal indicating the presence of the user in close distance to the cooking hob 21.

Said confirmation signal indicating the user's presence is provided by a microphone 45, also arranged at the front face of the exhaust hood 23. The microphone 45 is connected to the user interface 27 of the cooking hob 21 by means of a second transmission path 47, which may be an infrared signal connection. The microphone 45 may be designed as a directional microphone in order to filter out or reduce the operational noise, sourcing from the operation of the exhaust fan or its driving motor.

The microphone 45 is adapted for receiving any sound or noise created by a user being in close distance to the cooking hob 21. Such sound or noise may be a vocal sound, a snipping with fingers or the like. The sound or noise may be also created by the user working on the kitchen, in particular handling with specific devices, e. g. bumping with a pot 49 positioned on a cooking zone 25 of the cooking hob 21, toggling with a lid 51 of the pot 49, operating a water tap (not shown) in the kitchen, etc.

Figure 3:
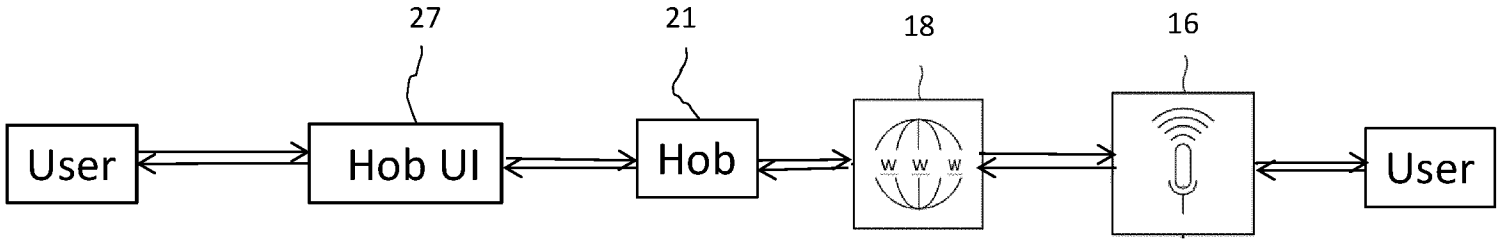
FIG. 3 illustrates a schematic view of an input and/or control system for an arrangement modified over the embodiment of FIG. 2.

Another embodiment of the present invention, modified vs. the arrangement as illustrated with FIG. 2 and as described above, is shown in FIG. 3. In line with the embodiment of FIG. 1, a voice control communication device 16 is provided and adapted to receive vocal input from the user and to perform acoustic output to the user. Both the voice control communication device 16 and the cooking hob 21 are able to communicate with the internet 18, in particular they are able to communicate with each other via the internet 18.

Also in this embodiment an input and/or control system is provided for activating the connection of the cooking hob 21 to the voice control communication device 16 and/or to the internet 18. But contrary to the solution of FIG. 1, a confirmation input or signal is not received by acoustic sensor, voice recognition and user recognition devices 10, 12, 14. Rather, user's closeness and/or attendance is recognized by the system by way of a near field communication means, in particular via an infrared or Bluetooth signal sent by remote control device 41, which confirmation input or signal, after having been received by the cooking hob 21 and/or the user interface 27 thereof, enables the user to provide commands and/or information or data inputs via the voice control communication device 16 and/or to the internet 18. Alternatively, a confirmation input may be also realized by the user directly switching on the cooking hob 21 using the ON/OFF switch 29". In that situation it is clear that the user is positioned in close proximity to the cooking hob 21 and user's attendance and immediate intervention, when necessary, can be expected, which is in line with legal safety requirements.

LIST OF REFERENCE NUMERALS

10 acoustic sensor
12 voice recognition sensor
14 user recognition device
16 voice control communication device
18 internet
21 cooking hob
23 exhaust hood
25 cooking zone (s)
27 user interface
29 hob operating buttons
29' universal operating buttons
31 display unit
33 microcontroller
35 suction area
37 exhaust tube
39 hood operating buttons
41 remote control device
43 first transmission path
45 microphone
47 second transmission path
49 pot
51 lid
HA household appliance

The invention claimed is:

1. A control system for a household appliance, comprising:

first input means configured to provide at least one of an information input, a function control input, and a condition control input for the household appliance, and second input means configured to provide a confirmation input configured to cause the control system to accept and to execute the at least one of the information input, the function control input, and the condition control input, wherein the control system is configured to receive, to accept, to process, and to execute the at least one of the information input, the function control input, and the condition control input provided via the first input means only after or concurrently with the confirmation input.

2. The control system according to claim 1, wherein the confirmation input is a local input, and wherein the control system is configured to accept the confirmation input from a user while located near the household appliance.

3. The control system according to claim 1, wherein the second input means is a button or a touch element, the button or touch element being located on a user interface of the household appliance.

4. The control system according to claim 1, wherein the second input means is a near field communication means, a camera, or a microphone located in, on, or near the household appliance.

5. The control system according to claim 1, wherein the control system comprises a physical key or a touch element, and a signal provider, wherein current flow to and voltage application at a heating element or at a control unit is enabled only when the physical key or the touch element is activated or when the signal provider provides an enabling signal.

6. The control system according to claim 1, wherein the first input means and the second input means are connected to or acting on a relay, a comparator, or a logic element.

7. The control system according to claim 1, wherein the first input means is a remote control device comprising a voice-operated or gesture-operated input or control means.

8. The control system according to claim 1, wherein the first input means is an apparatus or an uncoupled or stand-alone device connected to the household appliance via local area network connection means or via Wi-Fi connection means, the first input means being a or being connected to a digital assistant device.

9. The control system according to claim 1, wherein the first input means is or comprises a component or a device or an electric circuit integrated in the household appliance.

10. The control system according to claim 1, further comprising:

a first said first input means and a second said first input means, the first first input means being configured to provide at least one of a locally provided information input, a function control input, and a condition control input for the household appliance, and the second first input means being a button or key for a switch-on of the household appliance;

a first said second input means and a second said second input means, the first second input means configured to provide at least one of a remotely provided information input, a function control input, and a condition control input for the household appliance, and the second second input means being configured to provide a confirmation input configured to cause the control system to accept and execute the at least one of the remotely provided information input, the function control input, and the condition control input.

11. A method for operating a household appliance or for providing a household appliance with an input, wherein at least one of an information input, a function control input, and a condition control input from a user of the household appliance is received and processed by a control system for the household appliance only after a receipt of a confirmation input, the confirmation input being received prior to or at the latest concurrently with a first one of the at least one of the information input, the function control input, and the condition control input.

12. The method according to claim 11, wherein the confirmation input is received from or is provided by a user of the household appliance who is located near the household appliance while providing the confirmation input.

13. The method according to claim 11, wherein the confirmation input is configured to operate and control more than one of said information input, function control input, and condition control input, the confirmation input being a one-time input.

14. The method according to claim 11, wherein the confirmation input is controlling for a predefined or predefinable period of time or until a further user action is provided.

15. A household appliance comprising the control system according to claim 1.

16. A household cooking appliance comprising a control system adapted to execute a cooking function of the appliance based on a series of inputs;

said series of inputs comprising:

a command input to execute the cooking function that is received via a first input means, and a confirmation input that confirms a user is within proximity to the cooking appliance and which is received via a second input means;

wherein said first input means being a remote control or other stand-alone device that is in wireless communication with the control system of the appliance;

said second input means comprising:

a button, key, switch, or touch element on the appliance, or a sensor adapted to detect a presence of a user at a location that is within a defined proximity of the appliance;

wherein said control system is programmed to receive said command input and execute said cooking function only:

concurrently with or after receiving said confirmation input.

17. The household cooking appliance according to claim 16, said second input means being selected from the group consisting of a camera, a microphone, a vibration sensor, an infrared sensor, and a digital virtual assistant, wherein the second input means is disposed so that it is adapted to detect said user within said predefined proximity of the appliance, whereupon the second input means is further configured to transmit a corresponding signal comprising said confirmation input to the control system of the appliance, thereby confirming said proximity of said user.

18. The household appliance according to claim 16, said second input means comprising an ON switch of the household appliance, whereupon a user actuating the ON switch to activate the appliance communicates said confirmation input to said control system, thereby confirming said proximity of said user.

19. The household appliance according to claim 16, said first input means and said second input means both being connected to a logic element, which is physically comprised by said control system of the household appliance.

20. The household appliance according to claim 16, said control system being programmed to execute said cooking function only within a predetermined time period following receipt of said confirmation input, after expiration of which said confirmation input must be re-received in order to continue executing or to re-execute said cooking function.

* * * * *